US008058596B2

(12) United States Patent
Kinsey, Jr. et al.

(10) Patent No.: US 8,058,596 B2
(45) Date of Patent: Nov. 15, 2011

(54) METHOD OF CONTROLLING MISSILE FLIGHT USING ATTITUDE CONTROL THRUSTERS

(75) Inventors: Lloyd E. Kinsey, Jr., Pahoa, HI (US); James M. Cook, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 196 days.

(21) Appl. No.: 12/548,583

(22) Filed: Aug. 27, 2009

(65) Prior Publication Data

US 2011/0049289 A1 Mar. 3, 2011

(51) Int. Cl.

| | |
|---|---|
| ***F42B 15/01*** | (2006.01) |
| ***F42B 10/66*** | (2006.01) |
| *F42B 15/00* | (2006.01) |
| *F42B 10/00* | (2006.01) |

(52) U.S. Cl. ..... 244/3.22; 244/3.1; 244/3.15; 244/3.21

(58) Field of Classification Search ..... 244/3.1–3.3; 89/1.11

See application file for complete search history.

(56) References Cited

U.S. PATENT DOCUMENTS

| | | | | | |
|---|---|---|---|---|---|
| 3,374,967 | A | * | 3/1968 | Plumley | 244/3.14 |
| 3,591,108 | A | * | 7/1971 | Perkel et al. | 244/3.21 |
| 3,636,411 | A | * | 1/1972 | Bulloch | 244/3.22 |
| 3,643,897 | A | * | 2/1972 | Johnson, Jr. | 244/3.22 |
| 3,813,067 | A | * | 5/1974 | Mork | 244/3.22 |
| 3,843,075 | A | * | 10/1974 | Weber et al. | 244/3.15 |
| 3,843,076 | A | * | 10/1974 | King et al. | 244/3.16 |
| 3,937,423 | A | * | 2/1976 | Johansen | 244/3.22 |
| 3,998,409 | A | * | 12/1976 | Pistiner | 244/3.21 |
| 4,071,211 | A | * | 1/1978 | Muhlfelder et al. | 244/3.21 |
| 4,364,530 | A | | 12/1982 | Ripley-Lotee et al. | |
| 4,370,716 | A | * | 1/1983 | Amieux | 244/3.22 |
| 4,408,735 | A | * | 10/1983 | Metz | 244/3.22 |
| 4,465,249 | A | | 8/1984 | Selince | |
| 4,560,121 | A | * | 12/1985 | Terp | 244/3.22 |
| 4,568,040 | A | * | 2/1986 | Metz | 244/3.22 |

(Continued)

FOREIGN PATENT DOCUMENTS

WO 2008048702 A2 4/2008

(Continued)

OTHER PUBLICATIONS

International Search Report and Written Opinion from corresponding International Application No. PCT/US10/31676, Jan. 31, 2011.

*Primary Examiner* — Bernarr Gregory

(74) *Attorney, Agent, or Firm* — Renner, Otto, Boisselle & Sklar, LLP

(57) ABSTRACT

A method of controlling flight of a missile includes using gyroscopes, such as pitch rate gyroscopes, to sense when a factor based on the angular rate of change of the missile exceeds a threshold value. One the threshold value is exceeded, a decision may be made to use one or more compensation thrusters to reduce the angular rate of change. The use of the compensation thrusters may correct residual angular velocities from a pitch over maneuver used to put the missile on an intended course. In addition, the compensation thrusters may be used to compensate for errors in missile heading induced after the pitch over maneuver, such as induced by misalignment of thrust provided by a main rocket motor of the missile. Multiple compensation thrusters may be used to compensate for angular changes in the pitch and yaw directions.

20 Claims, 5 Drawing Sheets

U.S. PATENT DOCUMENTS 4,899,956 A * 2/1990 King et al. ..... 244/3.21
5,238,204 A * 8/1993 Metz ..... 244/3.15
5,456,429 A 10/1995 Mayersak
6,347,763 B1 2/2002 Harkins et al.
6,863,244 B2 * 3/2005 Fowell et al. ..... 244/3.16
7,350,743 B1 * 4/2008 Gate ..... 244/3.15
2009/0072076 A1 3/2009 Brinkerhoff et al.

FOREIGN PATENT DOCUMENTS

WO 20100036418 A2 4/2010

* cited by examiner

METHOD OF CONTROLLING MISSILE FLIGHT USING ATTITUDE CONTROL THRUSTERS

BACKGROUND OF THE INVENTION

1. Technical Field of the Invention

The invention is in the field of methods and devices for controlling missile flight.

2. Description of the Related Art

Methods of controlling missile flight of 360 degree capable rockets have often focused on using fins to steer the missile. Fins may be difficult to use, especially in situations where there is a short flight duration and severe changes in trajectory during flight.

SUMMARY OF THE INVENTION

According to an aspect of the invention, a method of controlling flight of a missile includes firing attitude thrusters when an angular rate is exceeded.

According to another aspect of the invention, a method of controlling flight of a missile includes the steps of: sensing a rate of change of angular orientation of the missile; and if the rate of change of angular orientation of the missile exceeds a threshold angular rate change value, making a decision regarding firing one or more compensation thrusters of the missile to change the rate of change of angular orientation of the missile.

According to yet another aspect of the invention, a method of controlling flight of a missile includes the steps of: sensing a rate of change of angular orientation of the missile; and if a factor based the rate of change of angular orientation of the missile exceeds a threshold factor value, making a decision regarding firing one or more compensation thrusters of the missile to change the rate of change of angular orientation of the missile.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily according to scale, show various aspects of the invention.

DETAILED DESCRIPTION

A method of controlling flight of a missile includes using gyroscopes, such as pitch rate gyroscopes, to sense when the angular rate of change of the missile, or more broadly a factor based on the angular rate of change, exceeds a threshold value. One the threshold value is exceeded, a decision may be made to use one or more compensation thrusters to reduce the angular rate of change. The use of the compensation thrusters may correct residual angular velocities from a pitch over maneuver used to put the missile on an intended course. In addition, the compensation thrusters may be used to compensate for errors in missile heading induced after the pitch over maneuver, such as induced by misalignment of thrust provided by a main rocket motor of the missile. Multiple compensation thrusters may be used to compensate for angular changes in the pitch and yaw directions, to keep the missile from veering too far from the course established by the pitch over missile.

Figure 1:
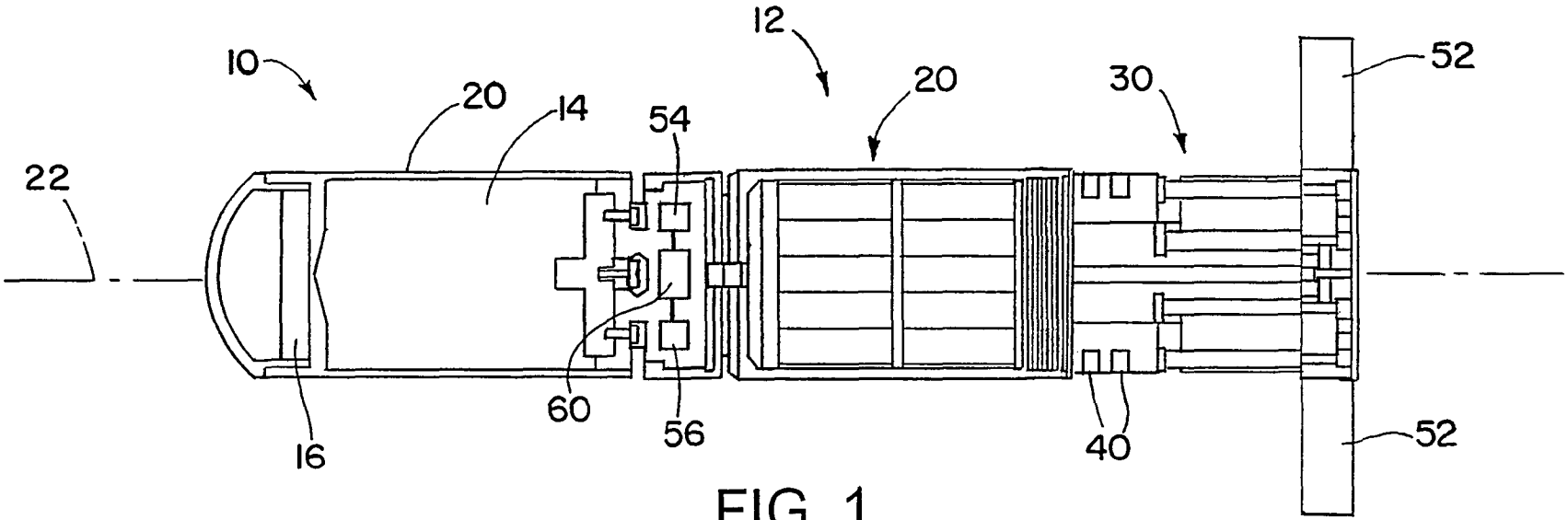
FIG. 1 is a side view of a missile in accordance with an embodiment of the invention.

FIG. 1 shows a missile 10 that may be guided to a target. The missile 10 may be used as an interceptor, to come near to or collide with a moving target. The missile has a fuselage 12 which houses a main rocket motor 20, for providing thrust along a longitudinal axis 22 of the missile 10. At the nose of the missile 10 may be a payload, such as a warhead 14 and fragments 16 in proximity to the warhead 14.

The missile 10 includes a series of pitch over motors 30 for altering the orientation and course of the interceptor missile 10. In the illustrated embodiment the interceptor missile 10 has four pitch over motors 30 axisymmetrically spaced around the back or aft end of the circumferential perimeter of a back or aft part of the fuselage (body) 12.

The pitch over motors 30 are used to reorient the missile 10 during flight. The pitch over motors 30 may each have substantially the same impulse, and each may be substantially identical. The control of orientation of the missile 10 may be accomplished by controlling the timing of the firing of the pitch over motors 30. For example, a small rotation in a given axis may be obtained by closely spacing in time the firings of a pitch over motor and its diametrically-oppose counterpart. Greater rotation of the missile about the axis may be obtained by increasing the time between firings of diametrically-opposed motors. Since the diametrically-opposed motors have substantially the same impulse, ideally there will be substantially no residual rotation of the missile after both pitch over motors have completed their burns. It will be appreciated that use of the pitch over motors 30 such as described above advantageously does not require any additional control of the pressurized gasses (such as by a variable nozzle) other than by control of the timing of the ignition of the pitch over motors 30.

The missile 10 also has a series of compensation thrusters 40 used to compensate for deviations in the angular velocity of the missile 10, for instance caused by residual rotation in the pitch or yaw directions remaining after the pitch over maneuver. One or more of the compensation thrusters may 40 be fired when the angular velocity exceeds a threshold value, which may be a constant or may be dependent on a number of factors. The compensation thrusters 40 may be arrayed along the circumference of the aft part of the fuselage (body) 12 of the missile 10.

More broadly, one or more of the compensation thrusters 40 may be fired when a factor based on the angular rate of change (angular velocity) exceeds a threshold value. One possibility, outlined in the previous paragraph, is that the factor is the angular rate itself (or is proportional to the angular rate), and that the threshold is an angular rate threshold. An alternative is that the sensed (measured) angular rates may be integrated to produce an angular displacement for use as a factor for triggering compensation thruster firing, with a threshold angular displacement used as the threshold for triggering compensation thruster firing. It will be appreciated that such an integration may be easily performed by multiplying a sensed angular rate of change by a time step over which the rate of change is sensed, with a sum of such integrations to approximate an overall angular displacement. The amount of angular correction a thruster causes could be calculated and used as the threshold for thruster firing.

In the discussion herein, nonzero angular rates of change are generally treated as errors, with the desirable angular rate of change being zero. While this may be true in some applications of the concepts described herein, it will be appreciated that more broadly the errors may be deviations from some desired angular rate of change, which is not necessarily zero. The missile 10 may have a preprogrammed desired flight path, or a desired flight path determined in flight, which may be used as a nominal basis from which deviations are determined, either in terms of angular rates, integrations of angular rates, or other factors based on angular rates of change. Thus the factor based on angular rate of change may be a difference between the angular rate of change (or angular displacement, such as determined through integration) and the angular rate of change or displacement of a desired flight path.

There may be different sizes of compensation thrusters 40 for providing thrust in each of multiple directions. Different sizes of the compensation thrusters 40 may be used for providing different amounts of thrust in given directions. As described further below, the missile 10 may be configured to fire the largest of the compensation thrusters 40 first, to provide large initial correcting thrust, with smaller compensation thrusters 40 used to make smaller corrections later in flight.

It will be appreciated that the compensation thrusters 40 may be used to correct for angular velocities induced in the missile 10 from factors other than residual velocities from a pitch over maneuver. For example some angular velocity may be induced by firing of the main motor 20, if the thrust of the main motor 20 does not align with the longitudinal axis 22.

The main motor 20, the pitch over motors 30, and the compensation thrusters 40 may all be solid rocket motors, using suitable solid fuel in conjunction with one or more nozzles for each of the motors or thrusters. Alternatively the main motor 20, the pitch over motors 30, and/or the thrusters 40 may use other types of fuel, or have other configurations. The pitch over thrusters or motors 30 may provide at least an order of magnitude more thrust than individual of the compensation thrusters 40. To give an example, the pitch over thrusters 30 may each provide a thrust of 1300 lbs for 15 ms, while the compensation thrusters 40 may each provide a thrust of 100 lbs for 8 ms. It will be appreciated that these are only example values, and that a wide range of other values are possible.

The missile 10 may have other suitable parts, including fins 52 that may be deployed from the fuselage 12, gyroscopes 54 and 56, and a controller 60. The gyroscopes 54 and 56 may be pitch rate gyroscopes used to determine angular velocities (rate of change of angle) in the pitch and yaw directions. Pitch rate gyroscopes are simpler, less expensive, and more robust than inertial measurement units (IMUs), which are often used in missile guidance.

The controller 60 is used to control the firing of the compensation thrusters 40, using input from the gyroscopes 54 and 56. The controller 60 may be a microcontroller that embodies the logic for determining whether and when to file one of more of the compensation thrusters 40.

It will be appreciated that the system described herein may be used to make all-aspect pitch-over missiles more accurate, and that the system could be used on a wide variety of other missiles which use a low-cost control system. This low-cost control system would be most useful in missiles where aero controls are not effective (e.g., for exo-atmospheric control), too expensive, or do not have enough control effectiveness (e.g., for short flight-time missiles).

Figure 2:
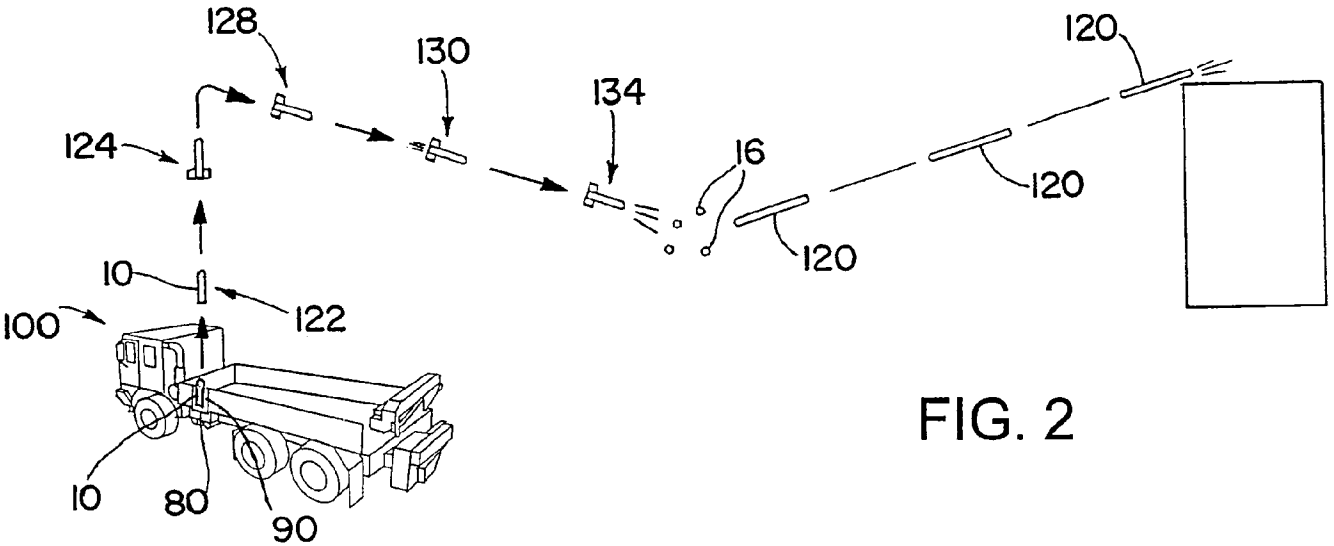
FIG. 2 is a diagram showing flight of the missile of FIG. 1.

FIG. 2 shows an example of the process of directing the missile 10, the example showing a process of the interception and disabling of an incoming projectile or missile (such as a rocket propelled grenade (RPG)) 120, fired at the ground vehicle 100. The missile 10 is initially located coupled to a launcher, and may be connected to the launcher 80 by an umbilical 90. Once the projectile 120 is detected the interceptor missile 10 is fired in a soft launch from the launcher 80, shown at reference number 122. The speed of the interceptor missile 10 when soft launched may be relatively small. If the missile 10 is soft launched at a sufficiently slow speed, such as from 18-37 m/sec (60-120 ft/sec), then the pitch over motors 40 can provide sufficient thrust to get to any angle within a desired time and distance.

After the soft launch, the fins 52 deploy as shown at step 124. The deployment of the fins 52 (if present) may be automatic once the interceptor missile 10 leaves the launcher 80. The fins 52 may be spring loaded or otherwise configured to automatically deploy.

The course alteration of the interceptor missile 10 is shown at step 128. As discussed above, the course alteration is accomplished by selectively firing of the pitch over motors 30, in order to quickly and efficiently move the interceptor missile 10 onto its desired course for intercepting the projectile 120. Information regarding the desired final course, or other instructions or information, may be forwarded to the interceptor missile 10 through the umbilical 90 that initially connects the launcher 80 and the missile 10.

After the desired orientation for the interceptor missile 10 has been achieved, the solid rocket motor 20 (FIG. 1) of the interceptor missile 10 is fired. This results in the boost phase shown at 130. In this phase the interceptor missile 10 greatly accelerates, speeding toward its intersection with the incoming projectile or missile 120. Velocity at motor burn out (the burn out of the solid rocket motor 30, the main boost propellant system for the interceptor missile 10) may be about 150 m/sec.

Finally, when the interceptor missile 10 is within a predetermined distance of the incoming projectile or missile 120, the missile warhead 14 (FIG. 1) detonates, as shown at 134. This violently propels the warhead fragments 16 (FIG. 1) toward the incoming projectile 120. Damage from the warhead fragments 16 disables the incoming projectile 120, preventing the projectile or missile 120 from reaching its target, the ground vehicle 100. The fragments 16 may be made of a heavy material, such as steel or tungsten.

As noted above, the compensation thrusters 40 (FIG. 1) may be fired at any time between the pitch over maneuver of step 128, and the warhead detonation at step 134. Any time that excessive angular rate changes in the pitch and/or yaw directions are detected, the controller 60 (FIG. 1) may be used to fire one or more of the compensation thrusters 40. This will reduce the angular rate change, driving the angular rate change closer to zero, the desired rate change when the missile 10 is on course toward its intended destination (target).

Figure 3:
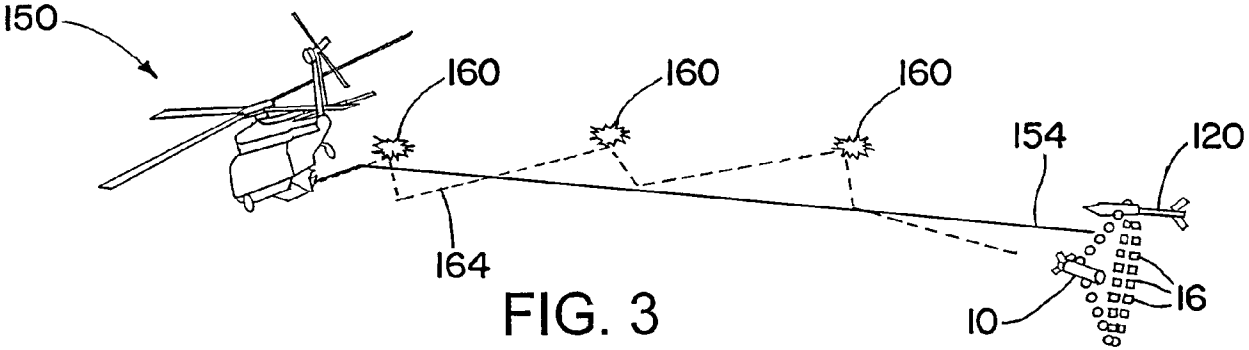
FIG. 3 is a diagram showing another type of flight of the missile of FIG. 1, illustrating launch from a helicopter.

FIG. 3 illustrates launch of the missile 10 from a flying platform, a helicopter 150. The missile 10 may be aimed to intercept an RPG 120 that is predicted to travel along a predicted flight path 154. Firing of the compensation thrusters 40

(FIG. 1) may be needed to correct the course of the missile 10 during flight, with such attitude control adjustment (compensation) provided by the compensation thrusters 40 at various points 160 during flight of the missile 10. This enables the missile 10 to proceed on a flight path 164 that remains close to the predicted flight path 154 of the RPG 120. The goal is for the missile 10 to be close enough to the RPG 120 upon detonation that the spread of the fragments 16 from the missile warhead's detonation impacts and at least disables the RPG 120, to prevent the RPG 120 from reaching its intended target, which may be the helicopter 150.

Figure 4:
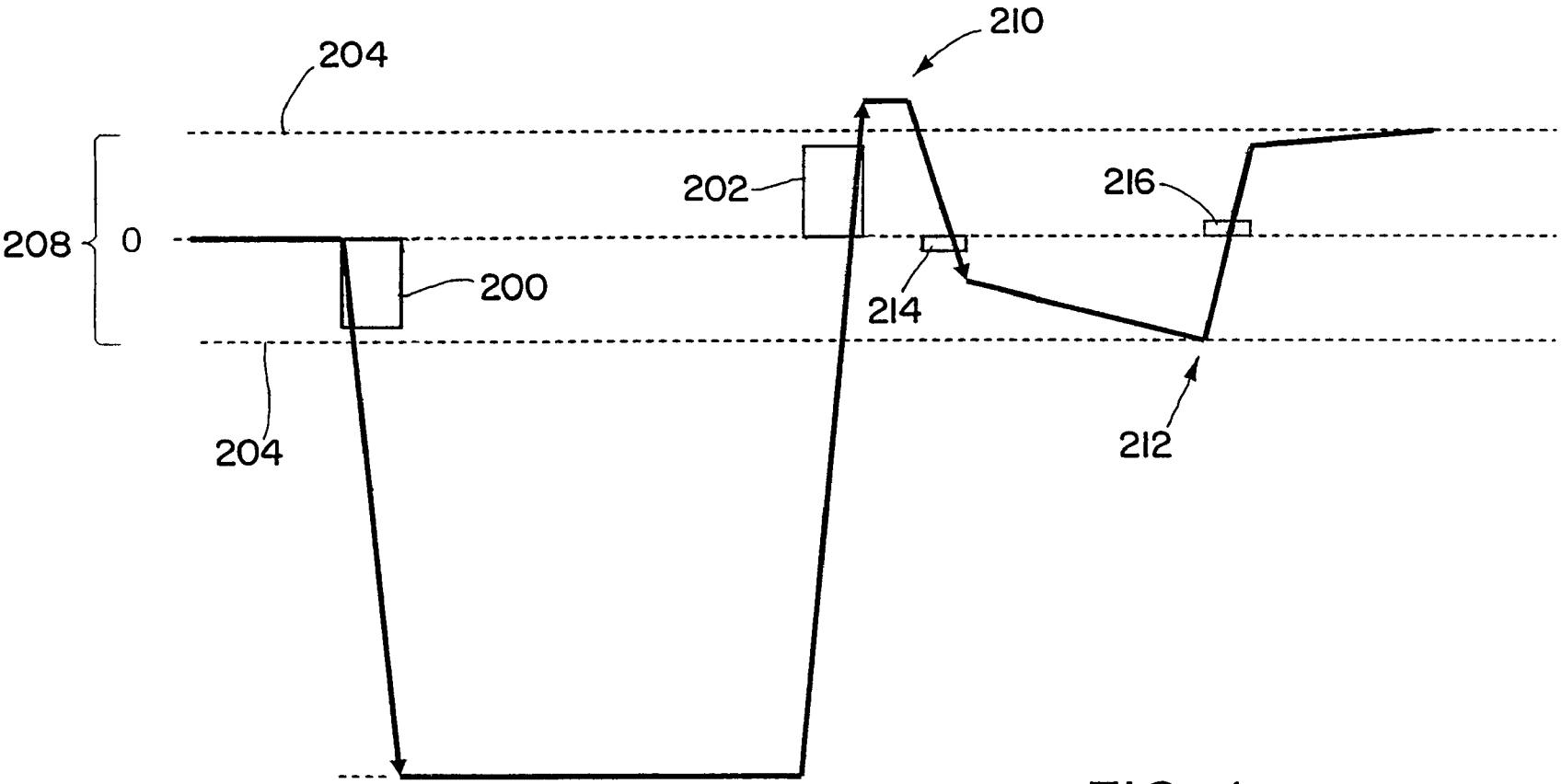
FIG. 4 is a plot showing an example of angular rate versus time, for missile flight controlled according to an embodiment method of the invention.

Referring now to FIG. 4, a plot shows an example of use of the compensation thrusters 40 (FIG. 1). The plot in FIG. 4 shows angular rate versus time for a missile 10 (FIG. 1) during and after a pitch over maneuver, such as is shown at step 128 in FIG. 2. The plot is for one of pitch or yaw, and it will be appreciated that the other direction may have similar changes in angular rate over time. The firing of the pitch over motors 30 (FIG. 1) is represented as thrust events 200 and 202. A predetermined angular rate threshold 204 is used in determining whether the compensation thrusters 40 need to be filed after the pitch over maneuver 128. If the threshold 204 is exceeded, then one or more of the compensation thrusters 40 is fired, to move the angular rate back toward zero, within the band 208 bounded by the angular rate thresholds 204.

The firing of the compensation thrusters 40 is triggered by two out-of-threshold events 210 and 212, which result in respective compensation thrust events 214 and 216. The out-of-threshold event 210 occurs due to residual angular rate left over after the pitch over maneuver. The event 210 is sensed by the gyroscopes 54 and 56 (FIG. 1), which provide angular rate information to the controller 60 (FIG. 1). The compensation thrust event 214 produced by firing of one or more of the compensation thrusters 40 compensates for the above-threshold angular velocity, moving the angular velocity back into the desired angular velocity band 208. As shown in FIG. 4, this may actually move the angular velocity past zero and in the other direction (from positive to negative in the illustrated case).

The residual angular rate after the compensation thrust event 214 can continue to drift, resulting in another out-of-threshold event 212, this time in the opposite direction from the out-of-threshold event 210. This triggers the compensation thrust event 216, firing of a compensation thruster 40 (FIG. 1) on the opposite side of the missile 10 (FIG. 1) from the compensation thruster 40 used for the compensation thrust event 214. This drives the angular rate back again within the desired angular velocity band 208.

FIG. 4 illustrates a simple compensation method, with fixed predetermined threshold levels, passing of which automatically triggers firing of one of the compensation thrusters 40 (FIG. 1). It will be appreciated that a variety of more complicated compensation methods are possible. For instance, the threshold level for triggering possible compensation thruster firing may be variable, with different threshold levels at different times, or triggered by different events. Firing of compensation thrusters and/or other thrusters may trigger changes in one or both of the thresholds 204. The changes may be temporary, in that the threshold 204 may temporarily decrease, then decay (for example linearly) back to the old values. As another example, the thresholds 204 may be increased during flight, such as when as the missile 10 (FIG. 1) nears its target point, in recognition that errors in angular velocity may be more tolerable at this point because such errors will have less time to take the missile 10 off of its intended flight path.

Another possible variation is to condition the firing of the compensation thrusters 40 (FIG. 1) on one or more factors, even when the thresholds 204 are exceeded. The decision of whether or nor to fire one or more of the compensation thrusters 40 may be more complicated than the automatic decision to fire a compensation thruster 40 that was illustrated in FIG. 4. Various factors such as the level of the angular rate and the distance (or time) to reach the intended target point may be used in making the decision whether to fire the compensation thrusters 40 at all. If a decision to engage compensation thrust is made, a further decision may be made as to how many compensation thrusters 40 to fire, and/or which of different sizes of compensation thrusters 40 to fire.

Another possible variant is control of the timing of the firing of the compensation thrusters 40 (FIG. 1), with the timing controlled or influenced by any or all of the various factors described above. Still another variable that may be invoked is whether the main rocket motor 20 (FIG. 1) is currently being fired. If the main motor 20 is being fired, this may impact decisions made in the controller 60 (FIG. 1) as to the timing of applying compensation thrust and/or the amount of compensation thrust used (by selection of the number and/or type of the compensation thrusters 40 employed.

Figure 5:
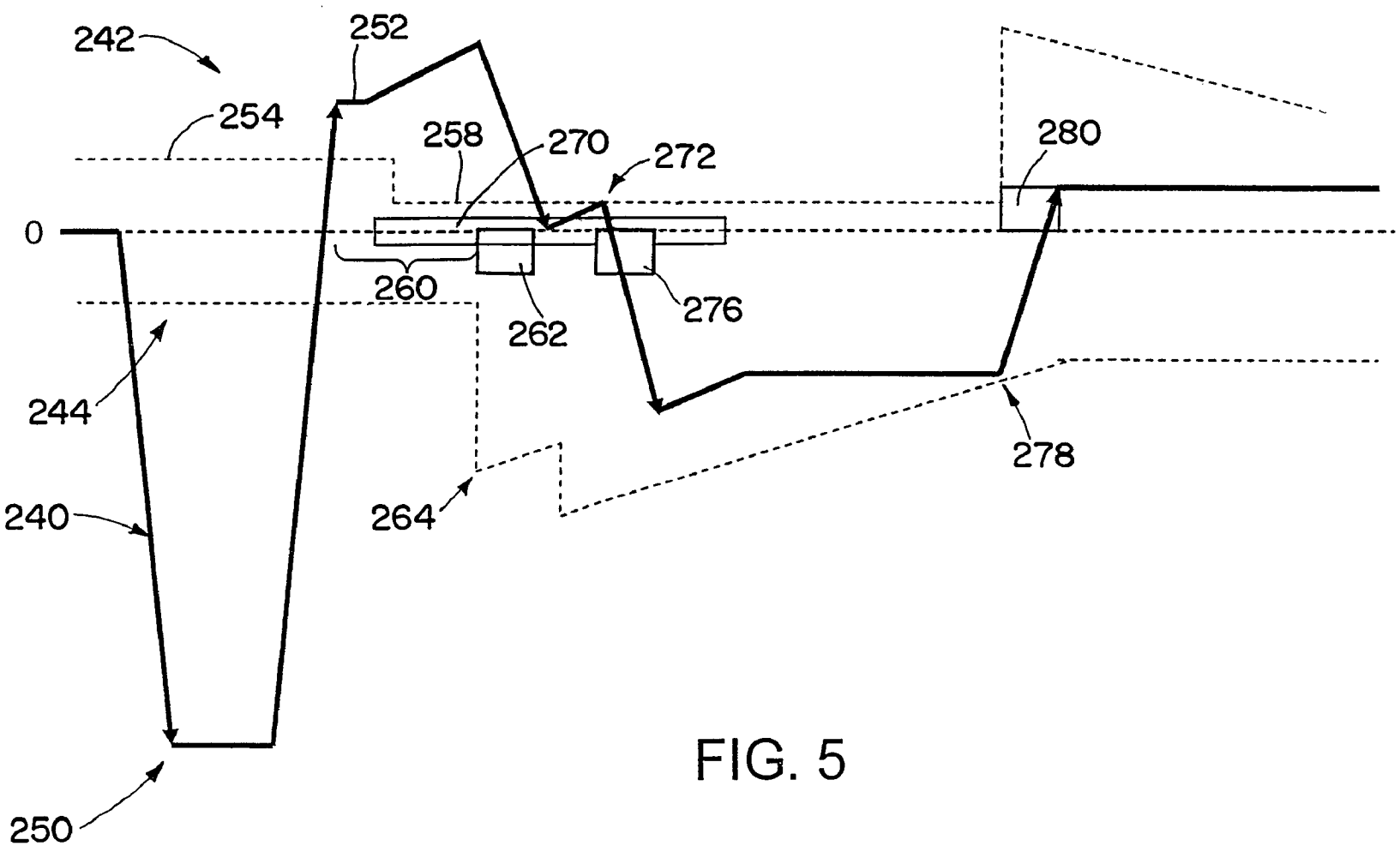
FIG. 5 is a plot showing another example of angular rate versus time, for missile flight controlled according to another embodiment method of the invention.

FIG. 5 shows an example of a more complicated way of setting thresholds, showing a plot over time of an angular rate 240 of a missile in certain direction (pitch or yaw), plotted over time. A positive angular rate threshold 242 and a negative angular rate threshold 244 change over time in response to various events. A pitch over maneuver 250 in the history shown in FIG. 5 is similar to that shown in FIG. 4. The pitch over maneuver 250 ends with a residual angular velocity 252 that is more than twice the initial positive threshold 254. This causes the system to reduce the positive threshold 250 to a lower threshold value 258. To give example numbers, this reduction may be from 40 degrees/sec to 10 degrees/sec. This may be done to help compensate for the large angular rate in the positive direction by reducing the amount of positive angular rate deviation that may be tolerated in the future.

After a read delay 260 one or more of the compensation thrusters 40 (FIG. 1) is fired, producing the compensation thrust event 262. This produces a negative movement of the angular rate 240. The negative compensation thrust event 262 may trigger a change in the negative threshold 264. The change may be an alteration, for example changing the negative threshold from −40 deg/sec to −160 deg/sec, expanding the band of acceptable angular rates. This change has a decay, an upward sloping of the negative threshold at 200 deg/sec$^2$, to give one example value. This may be done to avoid a situation of oscillating back and forth by rapid successive firings of compensation thrusters 40 (FIG. 1) in opposite directions. Such an effect may be termed a ping pong effect, and would be highly undesirable in that it may prematurely use up the available compensation thrusters.

At the same time the main rocket motor 20 (FIG. 1) is fired, producing a main rocket motor thrust event 270. In the illustrated example the thrust event 270 produces a positive change in the angular rate 240 throughout its duration, represented as an upward sloping of the angular rate 240 (when no negative compensation event is occurring).

The upward sloping from the main motor misalignment causes the angular rate to pass the positive threshold 242 at point 272. This triggers firing of another of the compensation thrusters 40 (FIG. 1), to produce a second negative thrust event 276. The negative threshold 244 may be extended farther from desired zero value for angular rate. This may be done whenever multiple compensation thrusters 40 in the same direction have been fired. Alternatively, the extension of the threshold may occur when a certain number of compensation thrusters in the same direction have been fired, such as all of the compensation thrusters in the given direction, or all of the compensation thrusters except those reserved for other purposes. With regard to latter option, for instance one of the compensation thrusters 40 for each of the directions may be reserved for flight path corrections, such as to correct for movement of a moving target. Alternatively or in addition one of the compensation thrusters 40 in each of the directions may be reserved for final aiming. Thus in a system with five compensation thrusters 40 in each of four or more directions, only three or four of the five compensation thrusters 40 may be available for use in providing compensation thrust events in response to exceeding angular rate thresholds. More broadly, some of the compensation thrusters 40 may be reserved for purposes other than response to exceeding angular rate thresholds.

The next compensation thruster 40 (FIG. 1) fires in response to the negative angular rate threshold 244 being passed at point 278. Although the angular rate 240 does not change substantially before reaching the point 278, the negative threshold 244 is passed because of the decay (reduction over time) of the negative threshold 244. This causes firing of one of the compensation thrusters 40 to produce a compensation thrust event 280 to affect the angular rate 240 by raising the angular rate 240 in the positive direction. At the same time an increase is made in the positive angular rate threshold 242, so as to avoid the ping pong effect referred to earlier.

Figure 6:
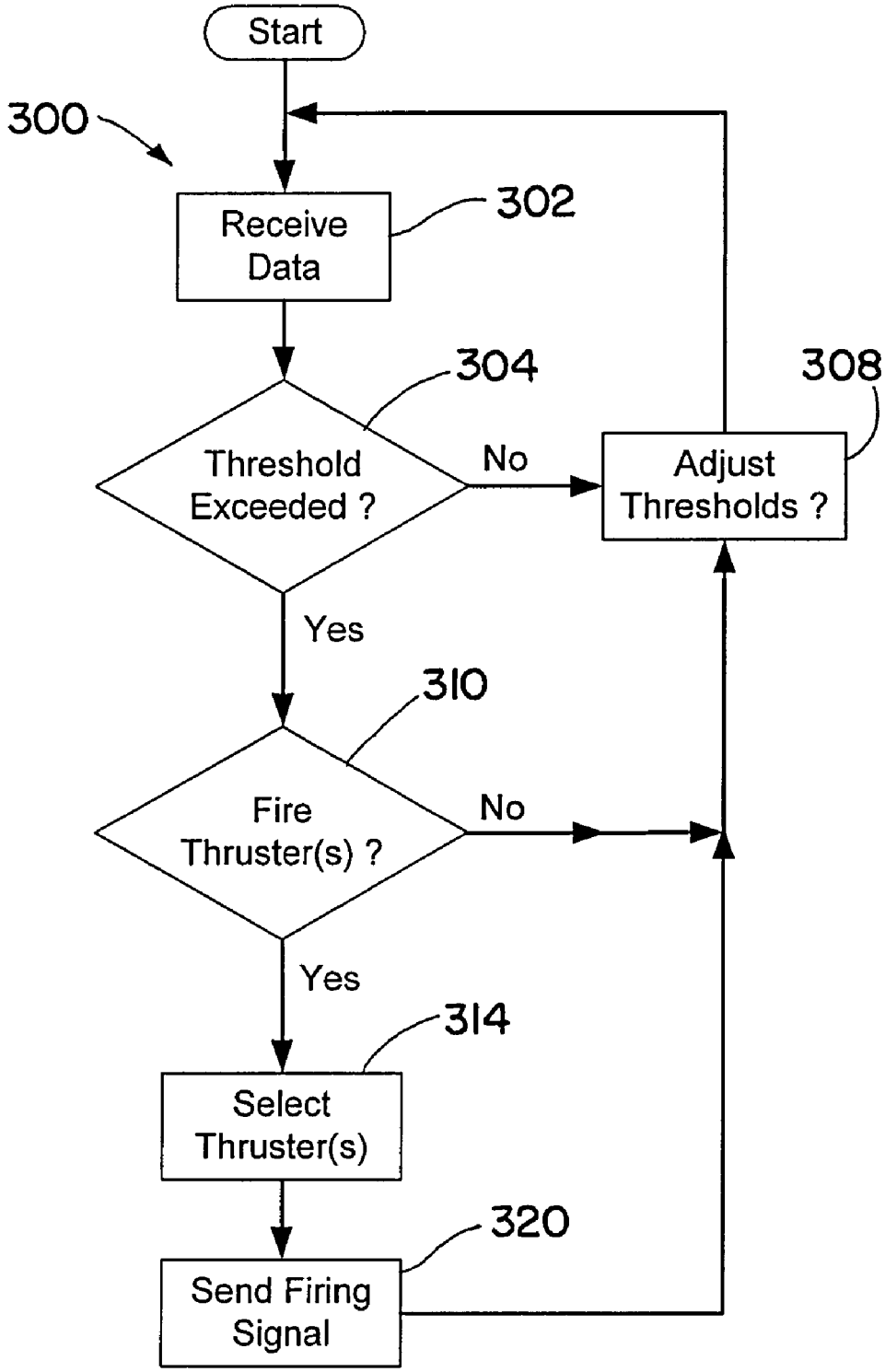
FIG. 6 is flow chart showing steps of a method that is an embodiment of the present invention.

FIG. 6 shows a high-level flow chart of a method 300 of controlling flight of the missile 10 (FIG. 1) using the compensation thrusters 40 (FIG. 1). The various steps in the method 300 occur in the controller 60 (FIG. 1). In step 302 the controller 60 receives data from the gyroscopes 54 and 56 (FIG. 1). In step 304 the angular rates in this data is compared to the thresholds for triggering possible compensation using the compensation thrusters 40. If the threshold is not exceeded, then the process returns to the beginning, perhaps after an adjustment of thresholds in step 308, such as because of a decay in one or more of the thresholds.

If the threshold is exceeded, then in step 310 a further decision point may be reached regarding whether one or more of the compensation thrusters 40 (FIG. 1) will be fired. As noted above, the firing of one or more of the compensation thrusters 40 may be automatic when the angular rate threshold is exceeded. Alternatively, a decision may be made in the controller 60 (FIG. 1) to not fire a compensation thruster even if the threshold is exceeded, for example if the missile 10 is close to its target point.

If a decision is made to fire one or more of the compensation thrusters 40 (FIG. 1), then a possible further decision is made in step 314 as to how many and/or which of the compensation thrusters 40 are to be fired, as well as the timing of the firing. Many factors may be used in making such a decision. It will appreciated that this step may be omitted, in that the number and/or size of the compensation thrusters 40 may be predetermined.

Finally a firing signal is sent in step 320 for the firing of one or more of the compensation thrusters 40 (FIG. 1). Then a threshold adjustment may be made in step 304, for example taking into account the firing of the one or more compensation thrusters 40.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of controlling flight of a missile, the method comprising:

changing orientation of the missile, wherein the changing the orientation is accomplished by firing pitch over thrusters;

after the changing orientation, sensing a rate of change of angular orientation of the missile, wherein the sensing the rate of change of angular orientation includes sensing a residual rate of change of angular orientation left over from the changing of the orientation of the missile; and if a factor based on the rate of change of angular orientation of the missile exceeds a threshold factor value, making a decision regarding firing one or more compensation thrusters of the missile to change the rate of change of angular orientation of the missile.

2. The method of claim 1, wherein the pitch over thrusters provide at least an order of magnitude more thrust than the compensation thrusters.

3. The method of claim 1, wherein the one or more thrusters include solid fuel thrusters; and wherein the firing includes firing one or more of the solid fuel compensation thrusters.

4. The method of claim 1, wherein the sensing the rate of change of angular orientation includes sensing changes to the rate of angular orientation induced by angular accelerations of the missile.

5. The method of claim 4, wherein the sensing includes sensing changes in angular orientation induced by thrust misalignment of rocket motor of missile.

6. The method of claim 1, wherein the threshold factor value is a predetermined constant threshold factor value.

7. The method of claim 1, further comprising changing the threshold factor value.

8. The method of claim 7, wherein the changing includes changing the threshold factor value in response to firing of one or more of the compensation thrusters.

9. The method of claim 7, wherein the threshold factor value includes a positive threshold value and a negative threshold value used for positive and negative changes in the factor, respectively; and wherein the changing includes changing the positive threshold value and the negative threshold values differently.

10. The method of claim 7, wherein the changing includes decreasing the threshold factor value when the factor exceeds a predetermined value.

11. The method of claim 7, wherein the changing includes temporarily increasing the threshold factor value, with the threshold factor value decaying over time after the temporarily increasing.

12. The method of claim 1, wherein the controlling flight includes controlling attitude in the pitch and yaw directions of the missile, with the sensing including sensing of pitch and yaw rates of change of angular orientation, and with the compensation thrusters including compensation thrusters providing attitude control moments for controlling attitude in the pitch and yaw directions.

13. The method of claim 1, wherein the sensing includes sensing using one or more gyroscopes.

14. The method of claim 13, wherein the one or more gyroscopes includes one or more pitch rate gyroscopes.

15. The method of claim 1, wherein the making a decision includes making a decision regarding timing of the firing.

16. The method of claim 1, wherein the compensation thrusters include differently-sized compensation thrusters; and wherein the making a decision includes deciding which of the differently-sized compensation thrusters to fire.

17. The method of claim 1, wherein the making a decision includes making a decision based at least in part on proximity of the missile to an intended target point.

18. The method of claim 1, wherein the factor is proportional to the rate of change of angular orientation.

19. The method of claim 1, wherein the factor is a difference between the rate of change of angular orientation and a rate of change of angular orientation of a desired flight path of the missile.

20. The method of claim 1, wherein the factor is an angular displacement calculated by integrating the sensed rate of change of angular orientation.

* * * * *